United States Patent [19]

Gardner

[11] Patent Number: 5,038,525

[45] Date of Patent: Aug. 13, 1991

[54] PIPE POLISHING APPARATUS AND METHOD

[76] Inventor: David E. Gardner, 8 Cedear Dr., South Easton, Mass. 02375

[21] Appl. No.: 501,559

[22] Filed: Mar. 29, 1990

[51] Int. Cl.[5] ..... B24B 19/00

[52] U.S. Cl. ..... 51/241 S; 51/245; 51/170 PT; 51/181 NT; 15/104.03; 15/104.09; 15/104.1 R

[58] Field of Search ..... 51/241 R, 241 S, 245, 51/170 PT, 170 EB, 179, 181 NT, 381, 384; 15/4, 104.01-104.05, 104.1 R

[56] References Cited

U.S. PATENT DOCUMENTS

| | | |
|---|---|---|
| 2,045,511 | 6/1936 | Babcock . |
| 2,225,272 | 12/1940 | Horne . |
| 2,303,824 | 12/1942 | Comins . |
| 3,188,674 | 6/1965 | Hobbs . |
| 4,246,728 | 1/1981 | Leasher . |
| 4,468,829 | 9/1984 | Christiansen . |
| 4,862,549 | 9/1989 | Criswell . |

FOREIGN PATENT DOCUMENTS

| | | | |
|---|---|---|---|
| 389638 | 9/1908 | France | 51/384 |

*Primary Examiner*—M. Rachuba
*Attorney, Agent, or Firm*—Richard P. Crowley

[57] ABSTRACT

A pipe end polishing apparatus and method which comprises a cradle having an open section and a pair of pivotable doors covering the open sections and adapted to move between an open, pipe receiving position and a closed, pipe polishing position, the doors biased to remain in an open, pipe receiving position. The doors and the cradle contain a resilient material on the inner surface to retain a pipe to be polished in the pipe polishing position. An endless belt is adapted to be placed about the exterior surface of the cradle and over the doors surface in the open, pipe receiving position and in the closed, polishing position to surround the end of the pipe to be polished. The method comprises placing a pipe to be polished in the pipe receiving position and moving the pipe radially downward so that the doors snap into a pipe polishing position, rotating the cradle, preferably by a power hand drill, to polish the pipe end and removing the pipe axially from the one end of the cradle to permit the doors to move again to the pipe receiving position for the next pipe to be polished.

24 Claims, 1 Drawing Sheet

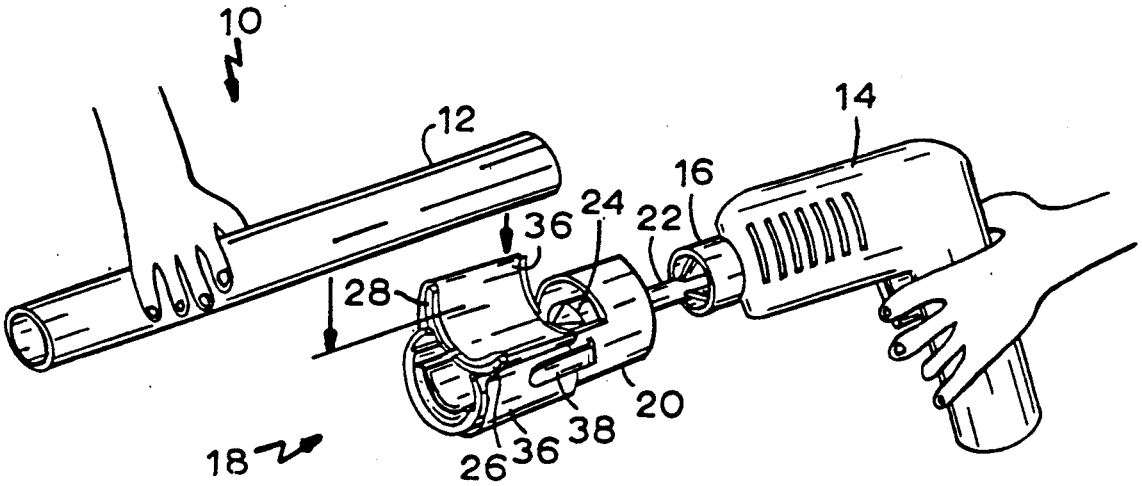
FIG. 1
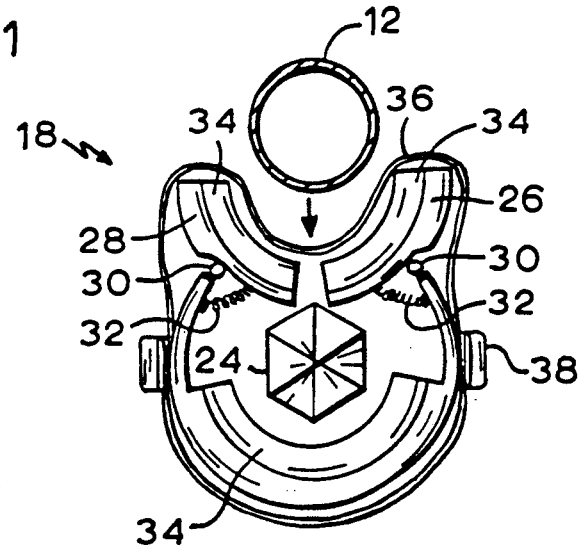
FIG. 2
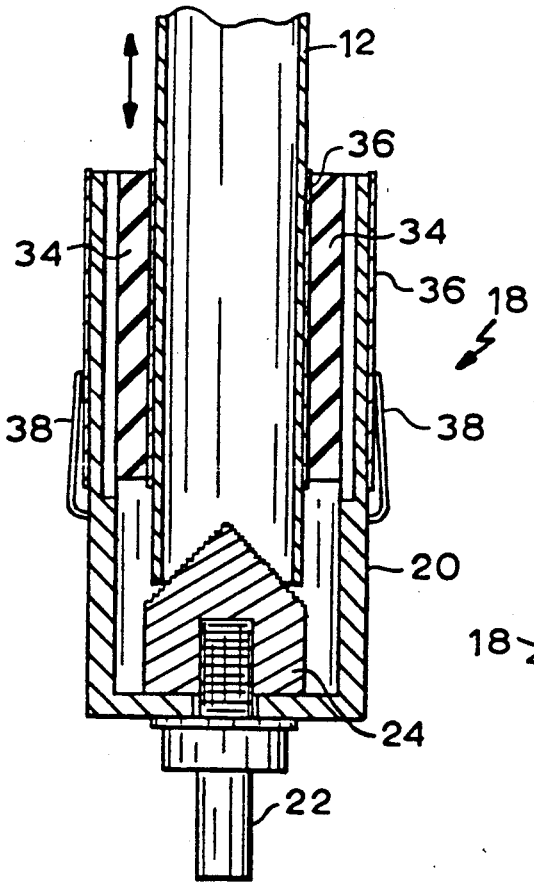
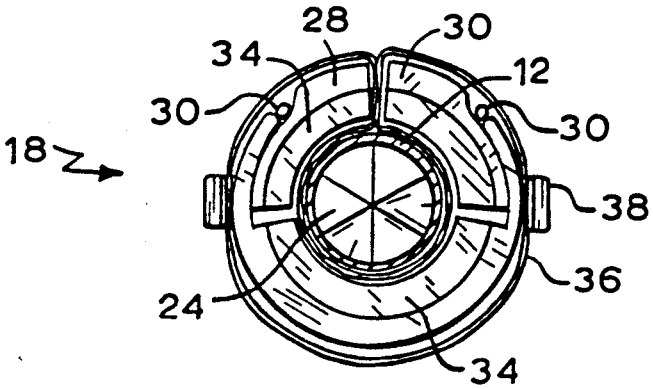
FIG. 3
FIG. 4

PIPE POLISHING APPARATUS AND METHOD

DESCRIPTION

BACKGROUND OF THE INVENTION

It is often desirable to provide for the rapid and efficient deburring, burnishing, cleaning, polishing, abrasion or otherwise treating the exterior and/or interior ends of a pipe or pipe-like material, for example, copper pipe used in plumbing systems in preparation for soldering or otherwise joining adjacent pipes. A number of polishing devices have been proposed for polishing or otherwise treating the interior and exterior surfaces of pipes or conduits. For example, U.S. Pat. No. 2,045,517, issued June 23, 1936, describes a polishing device for poles or pipes comprising a split clamping member connected for opening and closing movements through the use of trunnions and coiled expansion springs and which employs a polishing cloth about the pipe to be polished and embraced by the clamping jaws In the closed position so that the pipe may be polished.

U.S. Pat. No. 2,225,272, issued Dec. 17, 1940, concerns a device for the removal of burs and roughness at the end of a tube, such as a copper tube, through the employment of a steel cone having an abrasive surface mounted centrally of a plate having a shaft which is adapted to rotation by a drill.

U.S. Pat. No. 2,303,824 discloses a hose resizing tool device which employs an inside convex wire brush and an outside concave wire brush power driven to scrap the inside and the outside of the hose.

U.S. Pat. No. 3,188,674, issued June 15, 1965, also concerns a rotary tube end cleaning device which involves the use of a wire brush for rotation by an electrical drill operating device to effect cleaning of the exterior surface of the tube.

U.S. Pat. No. 4,246,728, issued Jan. 27, 1981, discloses a conduit end treating tool having a carrier provided with an adhesive-type substance, the carrier axially slotted to enable the carrier to expand and contract radially to cause the abrading material to engage the conduit to be abraded so that the inside or the outside of the conduit may be polished.

U.S. Pat. No. 4,468,829, issued Sept. 4, 1984, concerns a deburring tool for spent cartridge cases and provides a reamer as a deburring means for an inner and outer member to debur cartridge cases.

U.S. Pat. No. 4,862,549, issued Sept. 5, 1989, describes a pipe preparation device to prepare pipes for soldering or abrading and which comprises an internal brush and an external brush for the cleaning of the internal and external surfaces of a pipe prior to soldering or abrading, both brushes being provided in a single, hand driven tool.

It is desirable to provide for a new unique and efficient pipe polishing apparatus and method which overcomes at least some of the deficiencies of prior art pipe polishing apparatuses and which permits the rapid and efficient cleaning of the exterior ends of the pipe, and optionally, the interior of the pipe, particularly by the use of a hand drill in a rapid and efficient manner.

SUMMARY OF THE INVENTION

The invention relates to a pipe polishing apparatus and method particularly for the polishing of the external surface of the end of a pipe and optionally, the internal surface of the end of the pipe in a rapid and efficient manner.

A pipe or conduit polishing apparatus has been discovered which comprises a tubular pipe cradle having an open top section having an axial open end and an axial other end and the open section adapted to receive a pipe to be polished, particularly the end of a pipe to be polished or otherwise treated. The tubular cradle also includes a door means, particularly first and second pivotable doors, over the open top section of the cradle, the doors having an inner surface and the doors adapted to move between an open pipe receiving position wherein the doors are extended generally across the open section of the cradle and a closed pipe polishing position wherein the doors are pivotably moved to surround, together with the cradle, the pipe or conduit to be polished. The doors are pivotable connected to the cradle, typically on either side of the open section. The doors are biased, such as by spring or other type tension means, to remain in an open pipe receiving position, when the pipe is removed from the pipe polishing position so that the cradle is always ready to receive rapidly another pipe to be polished. Optionally and preferably, the cradle and the doors include a resilient means, such as a layer of foam or rubber on the internal surface thereof, to aid in retaining a pipe to be polished in a snug, pipe polishing position, so as to permit for slight adjustments in the variations of the pipes to be polished and also to retain the polishing material in a polishing relationship with the exterior surface of the pipe in the pipe polishing position.

The pipe polishing apparatus includes a polishing-type material, and more particularly, a sheet of abrasive type material, and preferably an endless belt having one or both sides of abrasive material and adapted to be placed about the cradle and over the inner surface of the doors when the doors are in the open pipe receiving position, so when the doors are placed in the closed pipe retaining position and the pipe surrounded in the cradle, the polishing material substantially surrounds in a polishing relationship the pipe to be polished with the polishing material between the resilient material on the exterior surface of the pipe in the pipe polishing position. Optionally, the cradle means may also include a spring clip or other retaining means to retain the polishing material in a desired position and also permit the polishing material to be periodically rotated circumferentially, so as to expose new polishing surfaces. The use of an endless belt with a pair of exterior, axially extending spring clips permits easy placement, removal and rotatable adjustment of the endless belt.

The pipe polishing apparatus, while it may be employed in a hand operation, is more preferably designed to be used with a hand drill or other power source. Therefore, at one end of the cradle there is provided an extending central shaft on the one closed end which may be secured to a chuck means, such as a cordless or electric hand drill, so that the cradle may be electrically driven and rotated in a polishing type operation. Also, it is desirable to provide in the same pipe polishing apparatus for the polishing or deburring or otherwise treating the internal surface of the end of the pipe through the employment of a reamer. Generally, the reaming operation may be accomplished by employing a wire brush or a conical-type device centrally positioned at the one end of the cradle and having an abrasive or roughened surface, so as to reach slightly inside the internal surface or the end of the pipe to ream, polish, abrade or otherwise treat the end of the pipe. Reaming of the pipe end or internal surface is affected by axial movement of the pipe in the pipe closing position by the user toward and into contact with the reamer positioned within and at the end of the cradle.

The pipe polishing apparatus and method of the invention is particularly effective when designed for employment with a hand drill, that is, the rotation of the cradle by insertion of an extending shaft into the chuck of a hand drill, and wherein the pipe polishing apparatus also includes a hand reaming apparatus so that both polishing of the exterior end surface of the pipe and the interior surface or end of the pipe may be accomplished through rotation of the cradle. The polishing of the exterior surface of the pipe or pipe end is accomplished through rotation of the cradle about its axis, either by hand or by a hand drill, while reaming of the end of the pipe is accomplished by axial movement of the pipe while in the pipe polishing position in the cradle against the surface of the wire brush or reaming apparatus at the other end of the cradle. The pipe polishing apparatus provides for the rapid and efficient polishing and reaming of pipe ends through its operation whereby a pipe is placed on the spring-biased door over the open section of the cradle, that is, in a pipe receiving position, and then placed in a pipe polishing position within the cradle, with the doors about the external surface, through downward radial pressure of the pipe by the user against the biased doors so as to snap fit the pipe end within the cradle in a pipe polishing position surrounded with the polishing belt. On rotation of the cradle, the polishing belt polishes the exterior surface of the pipe. The pipe polishing apparatus also permits optionally, the axial movement of the pipe within the cradle toward the reaming apparatus at the end of the cradle. After reaming, the pipe may be axially withdrawn from the cradle, and on withdrawal, the biased door, typically a pair of doors, is then automatically snapped into the pipe receiving position ready to receive the next pipe to be polished.

The pipe polishing apparatus of the invention is particularly useful, for example, in the plumbing field for the preparation of copper pipes in a plumbing operation. However, the pipe polishing apparatus may be employed to polish any tubular conduit materials and composed of any material as desired. The term "polishing" as employed in the description of the invention is meant to include and encompass the deburring, burnishing, cleaning, polishing, abrading or other treatment of the exterior surface of a pipe or a conduit-like tube, while the term "reaming" also includes the similar operation for the end or the internal surface of any pipe or conduit-like tube.

The polishing apparatus includes a fixed pipe cradle, typically composed of metal or plastic and wherein it has an arcuate type open top surface which is just sufficiently large to accept a pipe of defined diameter to be polished. The employment of a pair of doors over the open section permits the snap insertion of the desired pipe diameter into the interior of the cradle so that the generally, the open, arcuate-type section should be less than 180° in circumference, and typically, 150° to 180° in circumference and with a pair of acruate-shaped doors, one on either side, pivotably secured to the sides of the open section and biased outwardly. The doors typically have an arcuate surface so that in the pipe receiving position, the arcuate doors are adapted to receive the pipe and with the arcuate curve of the doors matching the arcuate surface of the cradle means, so that in the pipe polishing or closed position, the pipe to be polished is totally secured within the closed doors and cradle about the entire peripheral surface and with the sheet of polishing material, such as the endless belt, about substantially all of the exterior surface of the pipe. The belt is snugly fitted against the pipe through the use of the layer of resilient material which substantially surrounds the exterior pipe surface in the pipe polishing position and maintains the polishing belt in a good polishing, but not too tight, fit with the exterior surface of the pipe to be polished. The layer of resilient material and the abrasive belt material and the design of the cradle and the doors should be such as to permit the effective polishing of the exterior surface of the pipe by rotation of the cradle about the fixed pipe, such as by a hand drill, and yet permit the axial movement of the pipe by the user in the pipe polishing position. The snugness should be sufficient, so that the end of the pipe may be reamed if desired or otherwise treated, and the pipe may be moved axially outward from the open end of the cradle when the polishing is completed so that the pivotable biased doors may snap into the pipe receiving position to receive the next pipe to be polished. Typically, the pipe polishing apparatus of the invention is designed to provide for the polishing of copper pipes, for example, of ½", ¾", and 1" or larger pipes, so the cradle means is designed and selected, together with a layer of the resilient rubber means, for example, ⅛", to ⅜" in thickness, to accommodate such selected, standard pipes.

The polishing material to be used typically is a sheet of polishing material, and more particularly, an endless belt having an abrasive material on one or both sides and with the overall length to be determined by the size of the polishing tool to be used and particularly the use of a polishing belt, such as an endless belt of an emery-type cloth, may be slipped over the exterior surface of the cradle and over the open doors in the pipe receiving position and may be held in position for example by a pair of spring clips on opposing sides of the external surface of the cradle, which tends to hold the endless belt in place and to allow the user to advance the belt peripherally about the cradle as the belt is used in the polishing operation. The layer of resilient material used may vary as desired, but typically comprises a hard, friction-type rubber or neoprene material or a foam material and should be of sufficient depth and resiliency and friction to be sized right for the particular pipe to be polished and for the polishing material to be employed so that the pipe is held in a snug, pipe polishing relationship and yet permits axial movement in the pipe polishing relationship. The layer of resilient material also provides for the acceptance of pipe which may vary slightly in diameter.

The pipe polishing apparatus and method of the invention will be described for the purposes of illustration only in connection with certain preferred embodiments; however, it is recognized that various changes, modifications and additions may be made to the embodiments without departing from the spirit and scope of the invention.

BRIEF DESCRIPTION OF THE DRAWINGS

FIG. 1 is a perspective, illustrative view of a pipe polishing system, including the pipe polishing apparatus and a hand drill for the polishing of a pipe;

FIG. 2 is front elevational view of the pipe polishing apparatus of FIG. 1 and a pipe in an open pipe receiving position;

FIG. 3 is a front plan view of the pipe polishing apparatus of FIG. 1 with a pipe in a closed pipe polishing position; and FIG. 4 is a cross sectional view of the pipe polishing apparatus of FIG. 1 with a pipe in a polishing position.

DESCRIPTION OF THE EMBODIMENTS

FIG. 1 shows a pipe polishing system 10 comprising a copper pipe 12 whose end is to be polished, such as for example, polishing the end of the pipe to prepare the pipe for a soldering operation, the system 10 including a cordless electric hand drill 14 with a receiving chuck 16 and the pipe polishing apparatus of the invention 18. The pipe polishing apparatus comprises an open, arcuate top tubular plastic cradle 20 having a one free end and another closed end, with a cylindrical central shaft extending from the closed end 22 and secured to the closed end 22 through a nut and washer and including a conical shaped reaming apparatus 24 positioned within the one end of the cradle 20 and having a roughened surface adapted to ream or otherwise polish or treat the end of the interior surface of the pipe 12 when the pipe 12 is moved in an axial direction toward and into contact with the surface of the conical reamer 24. The cradle 20 includes a pair of outwardly biased, pivotable, arcuate doors 26 and 28 secured to each side respectively to the open sides of the cradle 20 through door hinges 30 and each of the doors containing a spring 32 on the outer surface and secured to the inner surface of cradle 20 to maintain the doors 26 and 28 in a biased, open, outward pipe receiving position with the inner arcuate surface of the doors standing outwardly. The doors 26 and 28 are selected to have the same radius as the cradle 20 and to fit the arcuate open section of the cradle 20.

As illustrated more particularly in FIG. 2 a hard, resilient, friction, rubber-type material is employed as a liner 34 on the inside, arcuate surface of the cradle 20 and on the inside, outwardly extending surface in the pipe receiving position of the doors 26 and 28 whereby the doors 26 and 28 are placed in a pipe polishing position. As illustrated more particularly in FIG. 3, the of resilient material 34 substantially also includes an emery cloth or abrasive endless belt 36 of the desired configuration and diameter, the belt 36 slipped around the outside exterior surface of the cradle 20 with the abrasive side outward and placed about the doors 26 and 28 in the open pipe receiving position adjacent the resilient material 34 on the doors 26 and 28. As illustrated, the endless belt 36 is retained in a polishing use position through the use of exterior, longitudinally extending axial spring clips 38 on either side of the cradle 20 which retains the belt in position and also enables the user of the pipe polishing apparatus 18 of the invention to peripherally move the belt so as to continually expose a new polishing or abrasive surface for use in the apparatus 18.

In operation, a user, such as a plumber, grasps with one hand a copper pipe 12 whose end is to be polished and reamed, and with the other hand grasps a cordless drill 14 containing a chuck 16 in which the pipe apparatus has been secured for rotational movement of the cradle 20 through the use of the extending shaft 22 in the drill chuck 16. As shown in FIG. 2, the pipe 12 is then placed against the upper surface of the abrasive belt 36 with the doors 26 and 28 in the open pipe receiving position and then pushed downwardly, that is, radially, toward the center axis of the cradle 20, and is snapped into a pipe polishing position as illustrated in FIG. 3 wherein the biased, pivotably hinged doors 26 and 28 surround the one surface of the pipe 12, and wherein the cradle 20 surrounds the remaining surface with the endless belt polishing material 36 against the layer of resilient material substantially totally surrounds the peripheral surface of the end of the pipe 12 in the pipe polishing position as also shown in sectional view FIG. 4.

In operation, the user actuates the drill 14 which causes the rotation of the cradle 20 so as to polish the exterior surface of the pipe 12 in the pipe polishing position within the cradle. The resilient layer 34 in the cradle is so sized to receive the pipe in a polishing, snug relationship which permits the rotation of the cradle 20 with the fixed, endless, abrasive belt 36 against the exterior surface of the pipe and 12 to effect a polishing operation and yet to permit the user to move the pipe 12 in an axial direction illustrated by the arrows in FIG. 4. In the pipe polishing system, and optionally the user may then if desired move the pipe 12 in the pipe polishing position inwardly toward the conical surface of the reamer 24 which is also rotating with the cradle 20 so as to effect a reaming or abrading operation on the ends and on the slight interior surface of the pipe 12 along with the polishing operation. The pipe polishing system permits the user then to withdraw the pipe 12 axially from the pipe polishing apparatus 28 through the open end of the cradle, so that the reaming and polishing operations are completed. On so doing, the spring-biased doors 26 and 28 automatically snap open into the pipe receiving position, as illustrated in FIG. 2, so that the user may then place another pipe to be polished on the open doors 26 and 28 and repeat the process.

The pipe polishing apparatus and method and system of the invention provide for a user with a cordless drill effectively, rapidly and efficiently to polish the exterior end of a pipe and also to ream the interior of the pipe.

What is claimed is:

1. A pipe polishing apparatus which comprises:

a) a tubular pipe cradle means having a top, open section and an axial one open end and an axial other end, the open section adapted to receive a pipe to be polished;

b) first and second pivotable door means each having an inner surface, the doors means movable between an open pipe receiving position and a closed pipe polishing position;

c) biasing means to bias the first and second door means into an open pipe receiving position when the pipe is axially removed from the cradle means;

d) resilient means on the inner surface of the cradle means to retain a pipe to be polished in a snug, pipe polishing position and to permit axial movement of the pipe in the pipe polishing position;

e) sheet polishing means placed on the inner surface of the first and second door means in the open position and in the closed pipe polishing position to surround in a polishing relationship a substantial portion of the pipe to be polished; and f) means at the other end of the cradle means to connect the cradle means to a rotatable power source to effect the rotation of the cradle means by the power source whereby the pipe to be polished is placed on the door means in the open position and snapped into a pipe polishing position by downward radial force against the door means, the cradle means rotated to effect polishing of the outer surface of the pipe by the polishing means and after polishing, the polished pipe is removed axially from the one open end of the cradle means whereby the door means moves by the biasing means into an open pipe receiving position for the next pipe to be polished.

2. The apparatus of claim 1 which includes at the other end of the cradle means a fixed, centrally position, extending shaft extending outwardly from the other end to provide for the rotation of the cradle means in the pipe polishing position.

3. A pipe polishing system which comprises the pipe polishing apparatus of claim 2 in combination with a hand drill having a chuck means to receive the centrally extending shaft so as to effect rotation of the cradle means by operation of the hand drill and thereby polishing the pipe in the cradle means.

4. The pipe polishing system of claim 3 which includes a cooper pipe whose exterior end surface is to be polished.

5. The apparatus of claim 2 which includes at the other end of the cradle means within the cradle means a pipe reaming means to provide on axial movement of the pipe in the pipe polishing position toward the other end the reaming the interior or end surface of the pipe.

6. The apparatus of claim 5 wherein the pipe reaming means comprises a generally conical surface reaming means the small conical end extending generally inwardly into the cradle means, the conical surface of the reaming means designed to provide for reaming of the interior of the pipe surface or end of the pipe surface.

7. The apparatus of claim 1 wherein the polishing means comprises an endless belt having an abrasive polishing surface, and the said belt placed about the outer surface of the cradle means and the inner surface of the door means in the open pipe receiving position.

8. The apparatus of claim 7 which includes an endless belt retaining means to hold the endless belt in position about the cradle means and to permit periodic movement of the belt by the user to expose a new polishing surface in use.

9. The apparatus of claim 8 wherein the belt retaining means comprises a spring clip on the exterior surface of the cradle means to retain the endless belt in position.

10. The apparatus of claim 1 wherein the resilient means is disposed on the inner surface of the cradle means and on the door means so that in the closed pipe polishing position, the resilient means substantially surrounds and retains the pipe to be polished in a snug pipe polishing position on rotation of the cradle and yet permits axial movement of the pipe in the pipe polishing position.

11. The apparatus of claim 1 wherein the biasing means comprises first and second spring means secured to the inside surface of the cradle means and respectively to the first and second door means to spring tension the first and second doors respectively into the open pipe receiving position.

12. The apparatus of claim 1 wherein the first and second means comprise generally arcuate-shaped, uniform width door means so as to complete the arcuate open section of the cradle means, the outer surface of the door means pivotably connected respectively to each side of the cradle means.

13. The apparatus of claim 1 wherein the resilient means comprises a layer of a resilient, frictional-type rubber material on the inner surface of the arcuate door means and on the inner surface of the cradle means so that in the closed pipe polishing position the layer of resilient means substantially surrounds the pipe to be polished and a portion of the arcuate first and second door means fits snugly against the arcuate section of the cradle means.

14. A pipe polishing apparatus which apparatus comprises:

a) a tubular pipe cradle means having an arcuate open top section and an axial open end and an axial other end, the arcuate open section to receive a pipe to be polished and having an opening of less than about 180°;

b) first and second pivotable door means having an inner surface, the first and second door means hingedly secured to the sides of the arcuate open section and movable between an open pipe receiving position and a closed pipe polishing position, the first and second door means arcuate in shape and designed to complete the arcuate open section of the cradle means;

c) biasing means to bias the first and second door means to an open pipe receiving position when the pipe is removed from the cradle means, the biasing means secured to the cradle means and to the arcuate door means;

d) a layer of resilient material on the inner surface of the cradle means and on the inner surface of the door means to retain a pipe to be polished in a snug, pipe polishing position and yet to permit the pipe to be axially removed from the cradle means;

and endless belt polishing means fitted around the cradle means and to be placed on the inner surfaces of the arcuate first and second door means and in the closed pipe polishing to surround in a snug pipe polishing relationship the end of the pipe to be polished; and f) a centrally extending means extending form the other end of the cradle means, the central shaft fitting into a power hand drill and to effect rotation of the cradle means whereby the end of a pipe to be polished, the pipe is placed in the door means in the open position and snapped into an end pipe polishing position by downward radial force against the door means, the cradle means then rotated through employment of a hand drill to effect polishing of the outer surface of the pipe by the endless belt polishing means, and after polishing, the polished pipe is removed axially from the one open and of the cradle means whereby the first and second door means move automatically by the spring tension means into an open pipe receiving position for the next pipe to be polished.

15. The pipe polishing apparatus of claim 14 which includes a pipe reaming means generally centrally secured at the other end of the cradle means and within the cradle means to effect the reaming of the interior surface of the end of the pipe through the axial movement of the pipe in the pipe polishing position toward the pipe reaming means.

16. A pipe polishing system which includes the pipe polishing apparatus of claim 14 and a hand drill having a chuck, the chuck adapted to receive the shaft extending from the other end of the cradle means and to effect rotation of the cradle means in the pipe polishing position.

17. The pipe polishing apparatus of claim 16 which includes a copper pipe wherein an exterior end surface is to be polished and wherein an interior end surface is to be reamed.

18. A method of polishing the exterior surface of a pipe, which method comprises:

a) providing a tubular cradle means having an axis and a radius and a one and other end, and a door means having a sheet of polishing material on the inner surface the door means movable between a biased, door open pipe receiving position and a closed door pipe polishing position whereby the pipe is received within the cradle means, the door means and cradle means surrounding the pipe, in a snug polishing relationship, and retaining the polishing material by resilient means on the inner surface of the door and cradle means;

b) placing the pipe to be polished into a pipe polishing position by placing the pipe on the outwardly extending door means in the open pipe receiving position and snap fitting the pipe radially downward into a pipe polishing position within the cradle means to surround the pipe with the cradle means and the door means;

c) rotating the cradle means employing a power means axially secured to the one end of the cradle means to effect polishing of the exterior end surface of the pipe; and d) removing the pipe from the open end of the cradle means by axial movement and automatically placing the door means in the biased open pipe receiving position to receive a pipe.

19. The method of claim 15 wherein the power means comprises a hand drill and wherein the cradle means includes placing a central shaft extending from other end thereof into the power drill for rotation.

20. The method of claim 18 which includes securing within the other end of the cradle means a reaming means and effecting reaming of the pipe in the pipe polishing position by axial movement of the pipe in the pipe polishing position against the reaming means.

21. The method of claim 20 which includes employing a generally conical surface reaming means having a spherical, conical surface and reaming the interior end surface of the pipe on axial movement of the pipe against the conical surface.

22. The method of claim 18 which includes placing an endless belt of a polishing material about the outside of the cradle means and the inside surface of the door means whereby in the pipe polishing position the polishing material surrounds the pipe to be polished and is retained in position by the resilient means.

23. The method of claim 22 which includes securing the polishing material to the outside surface of the cradle means and periodically rotating the endless belt polishing material to expose a new polishing surface.

24. The method of claim 18 which includes placing a uniform layer of a resilient frictional type material on the inside surface of the cradle means and the door means to place the pipe in a snug, polishing relationship with the polishing material in the pipe polishing position.

* * * * *